US009303395B2

(12) United States Patent
Shirakawa et al.

(10) Patent No.: US 9,303,395 B2
(45) Date of Patent: Apr. 5, 2016

(54) FLUSH TOILET

(71) Applicant: TOTO LTD., Kitakyushu-shi, Fukuoka (JP)

(72) Inventors: Shigehisa Shirakawa, Kitakyushu (JP); Jing Chen, Munakata (JP)

(73) Assignee: TOTO LTD., Fukuoka (JP)

( * ) Notice: Subject to any disclaimer, the term of this patent is extended or adjusted under 35 U.S.C. 154(b) by 241 days.

(21) Appl. No.: 14/226,423

(22) Filed: Mar. 26, 2014

(65) Prior Publication Data

US 2015/0026876 A1 Jan. 29, 2015

(30) Foreign Application Priority Data

Jul. 25, 2013 (JP) ..... 2013-154231

(51) Int. Cl.
*E03D 11/02* (2006.01)
*E03D 11/08* (2006.01)

(52) U.S. Cl.
CPC ..... *E03D 11/08* (2013.01); *E03D 2201/30* (2013.01); *E03D 2201/40* (2013.01)

(58) Field of Classification Search
CPC ..... E03D 11/02; E03D 11/06; E03D 11/08; E03D 11/18; E03D 2201/30
USPC ..... 4/420, 421, 425
See application file for complete search history.

(56) References Cited

U.S. PATENT DOCUMENTS 6,145,138 A * 11/2000 Nakamura ..... E03D 11/02 4/420
2006/0005310 A1* 1/2006 Nakamura ..... E03D 11/08 4/420
2012/0198610 A1* 8/2012 McHale ..... E03D 11/08 4/421
2013/0047326 A1* 2/2013 Yamasaki ..... E03D 11/08 4/345
2013/0219605 A1* 8/2013 Grover ..... E03D 11/08 4/300.3

* cited by examiner

*Primary Examiner* — Huyen Le
(74) *Attorney, Agent, or Firm* — Brooks Kushman P.C.

(57) ABSTRACT

A flush toilet which is capable of completing flushing of a bowl portion at or before termination of a siphon action, thereby improving toilet flushing performance in a situation where flushing is performed while generating a siphon action by using a reduced amount of flush water. The flush toilet is configured such that, after a first rim water spouting portion starts to spout flush water therefrom, a jet water spouting portion and a second rim water spouting portion start to spout flush water therefrom, in this order.

4 Claims, 5 Drawing Sheets

FLUSH TOILET

CROSS-REFERENCE TO RELATED APPLICATIONS

This application claims priority to JP application JP 2013-154231 filed on Jul. 25, 2013, the disclosure of which is incorporated in its entirety by reference herein.

TECHNICAL FIELD

The present invention relates to a flush toilet, and more particularly to a flush toilet using flush water to clean or flush a toilet main unit.

BACKGROUND

Heretofore, there has been known a flush toilet which comprises a bowl portion having a rim formed to define an inner peripheral surface thereof along an upper edge thereof, wherein the flush toilet is configured to spout flush water forwardly (i.e., toward a forward side of a toilet main unit) from a rim spout port and utilize a resulting swirl flow to clean or flush the bowl portion, as described, for example, in JP 4284703B (Patent Document 1). More specifically, this type of flush toilet comprises: two rim spout ports each configured to spout flush water therefrom in the same swirling direction, so as to allow flush water to be distributed all over the bowl portion while swirlingly flowing on the bowl portion; and a jet spout port configured to spout water therefrom in a jetting manner to generate a siphon action within a drainage trap, thereby expelling waste from the toilet main unit.

SUMMARY

Technical Problem

However, in the conventional flush toilet as described in the Patent Document 1, a water guiding passage extending forwardly from a position just below an opening of a bottom of a reservoir tank along a laterally approximately central region of the flush toilet in the form of a common passage is divided into three passages: two rim water guiding passages and a jet water guiding passage, at a downstream end of the common passage, in such a manner as to allow flush water from the common passage to simultaneously flow into the respective divided passages.

The conventional flush toilet is configured such that, after flush water supplied from the reservoir tank flows into the jet water guiding passage, the jet spout port first starts to spout therefrom flush water which has passed down through the jet water guiding passage, to generate a siphon action at a relatively early timing, whereafter the two rim spout ports start to spout therefrom flush water which has passed down through the respective rim water guiding passages, thereby initiating swirl flow-based flushing of the bowl portion.

Meanwhile, in a situation where, in order to meet a recent demand for water-saving, the conventional flush toilet is modified into a water-saving type by reducing an amount of flush water for flushing the toilet main unit, an amount of flush water to be spouted from the jet spout port is reduced, and therefore a duration of the siphon action becomes shorter than that of the pre-modification, non-water-saving type. Thus, the water-saving type flush toilet is likely to fail to complete flushing of the bowl portion at or before termination of the siphon action. This results in a problem that waste remains in the bowl portion without being expelled by the siphon action.

It is therefore an object of the present invention to provide a flush toilet capable of completing flushing of a bowl portion at or before termination of a siphon action, thereby improving toilet flushing performance in a situation where flushing is performed while generating a siphon action by using a reduced amount of flush water.

Solution to the Technical Problem

In order to achieve the above object, the present invention provides a flush toilet using flush water to flush a toilet main unit. The flush toilet comprises: a reservoir tank storing therein flush water to be supplied to the toilet main unit, wherein the reservoir tank is formed with a discharge port for discharging flush water therethrough; a bowl portion having a bowl-shaped waste-receiving surface, and a rim defining an inner peripheral surface of the bowl portion located along an upper edge of the bowl portion; a drainage passage having an inlet connected to a lower region of the bowl portion to expel waste therethrough by a siphon action; a first rim water spouting portion provided at a position lying in the rim and corresponding to a lateral region of the bowl portion, to spout flush water therefrom toward a forward side of the toilet main unit in such a manner as to allow the flush water to flush the bowl portion while swirlingly flowing along the inner peripheral surface of the rim; a second rim water spouting portion provided at a position lying in the rim and corresponding to a rear region of the bowl portion, to spout flush water therefrom in such a manner as to allow the flush water to flush the bowl portion while swirlingly flowing along the inner peripheral surface of the rim in a same swirling direction as that of flush water spouted from the first rim water spouting portion; a jet water spouting portion for spouting flush water therefrom toward an inlet of the drainage passage; a flow dividing chamber for dividing flush water flowing therein from the reservoir tank; a first rim water guiding passage for guiding flush water from the flow dividing chamber to the first rim water spouting portion; a jet water guiding passage for guiding flush water from the flow dividing chamber to the jet water spouting portion; and a second rim water guiding passage for guiding flush water from the flow dividing chamber to the second rim water spouting portion, wherein the flush toilet is configured such that, after the first rim water spouting portion starts to spout flush water therefrom, the jet water spouting portion and the second rim water spouting portion start to spout flush water therefrom, in this order.

In the above flush toilet of the present invention, the first rim water spouting portion first starts to spout flush water therefrom. This makes it possible to initiate swirl flow-based flushing of the bowl portion earlier than the conventional flush toilet, thereby allowing waste to gather in a center of pooled water in the bowl portion at an earlier timing than the conventional flush toilet. Then, after start of the spouting of flush water from the first rim water spouting portion, the jet water spouting portion starts to spout flush water therefrom. Thus, based on a synergetic effect of flush water spouted from the jet water spouting portion and flush water spouted from the first rim water spouting portion to the bowl portion, it becomes possible to expel waste by a siphon action, at a later timing than the conventional flush toilet. Lastly, the second rim water spouting portion starts to spout flush water therefrom. This makes it possible to quickly flush a rear region of the bowl portion which has difficulty in undergoing flushing with flush water spouted from the first rim water spouting portion, and allow waste to gather in the center of the pooled water in the bowl portion within a duration of remaining the siphon action. As a result, the flush toilet of the present invention can complete flushing of the bowl portion at or before termination of the siphon action. Therefore, it becomes possible to improve toilet flushing performance in a situation where flushing is performed while generating a siphon action by using a reduced amount of flush water.

Preferably, in the flush toilet of the present invention, the flow dividing chamber is formed with: a first rim water guiding passage-feeding port for allowing flush water to flow into the first rim water guiding passage therethrough; a jet water guiding passage-feeding port for allowing flush water to flow into the jet water guiding passage therethrough; and a second rim water guiding passage-feeding port for allowing flush water to flow into the second rim water guiding passage therethrough, wherein the first rim water guiding passage-feeding port, the jet water guiding passage-feeding port and the second rim water guiding passage-feeding port are arranged in this order from an upstream side of the flow dividing chamber.

According to this feature, first, flush water flows into the first rim water guiding passage-feeding port from an upstream side of the flow dividing chamber, to allow the first rim water spouting portion to start to spout flush water therefrom. Then, flush water flows into the jet water guiding passage through the jet water guiding passage-feeding port arranged on a second upstreammost side of the flow dividing chamber, to allow the jet water spouting portion to start to spout flush water therefrom. Lastly, flush water flows into the second rim water guiding passage through the second rim water guiding passage-feeding port arranged on a downstreammost side of the flow dividing chamber, to allow the second rim water spouting portion to start to spout flush water therefrom. Thus, the first rim water spouting portion first starts to spout flush water therefrom, so that it becomes possible to initiate swirl flow-based flushing of the bowl portion earlier than the conventional flush toilet. Therefore, it becomes possible to allow waste to gather in the center of the pooled water in the bowl portion at an earlier timing than the conventional flush toilet. Then, after start of the spouting of flush water from the first rim water spouting portion, the jet water spouting portion starts to spout flush water therefrom. Thus, based on a synergetic effect of flush water spouted from the jet water spouting portion and flush water spouted from the first rim water spouting portion to the bowl portion, it becomes possible to expel waste by a siphon action, at a later timing than the conventional flush toilet. Lastly, the second rim water spouting portion starts to spout flush water therefrom. This makes it possible to quickly flush a rear region of the bowl portion which has difficulty in undergoing flushing with flush water spouted from the first rim water spouting portion, and allow waste to gather in the center of the pooled water in the bowl portion within a duration of the siphon action. As a result, the flush toilet having the above feature can complete flushing of the bowl portion at or before termination of the siphon action. Therefore, it becomes possible to improve toilet flushing performance in the situation where flushing is performed while generating a siphon action by using a reduced amount of flush water.

More preferably, in the above flush toilet, the first rim water guiding passage-feeding port of the flow dividing chamber is disposed in adjacent relation to the discharge port of the reservoir tank.

According to this feature, flush water discharged from the reservoir tank is guided from the first rim water guiding passage-feeding port to the first rim water spouting portion, reliably at an earliest timing. Thus, it becomes possible to allow the first rim water spouting portion to start to spout flush water therefrom at the earliest timing.

More preferably, in the above flush toilet, each of the jet water guiding passage-feeding port and the second rim water guiding passage-feeding port is disposed at a position away from the discharge port by a distance greater than a distance from the discharge port to the first rim water guiding passage-feeding port, wherein the second rim water guiding passage-feeding port is disposed in adjacent relation to the jet water guiding passage-feeding port.

According to this feature, it becomes possible to allow the first rim water spouting portion to start to spout flush water therefrom at the earliest timing in a reliable manner. Then, after start of the spouting of flush water from the first rim water spouting portion, the jet water spouting portion secondly starts to spout flush water therefrom. Thus, based on a synergetic effect of flush water spouted from the jet water spouting portion and flush water spouted from the first rim water spouting portion to the bowl portion, it becomes possible to expel waste by a siphon action, at a later timing than the conventional flush toilet, in a more reliable manner. The second rim water guiding passage-feeding port is disposed in adjacent relation to the jet water guiding passage-feeding port, so that it becomes possible to allow the second rim water spouting portion to start to spout flush water therefrom at a timing relatively shortly after start of the spouting of flush water from the jet water spouting portion. As a result, the flush toilet having the above feature can complete flushing of the bowl portion at or before termination of the siphon action. Therefore, it becomes possible to improve toilet flushing performance in the situation where flushing is performed while generating a siphon action by using a reduced amount of flush water.

Advantageous Effects of the Invention

The flush toilet of the present invention can complete flushing of the bowl portion at or before termination of a siphon action, and thereby improve toilet flushing performance in the situation where flushing is performed while generating a siphon action by using a reduced amount of flush water.

DETAILED DESCRIPTION

Figure 1:
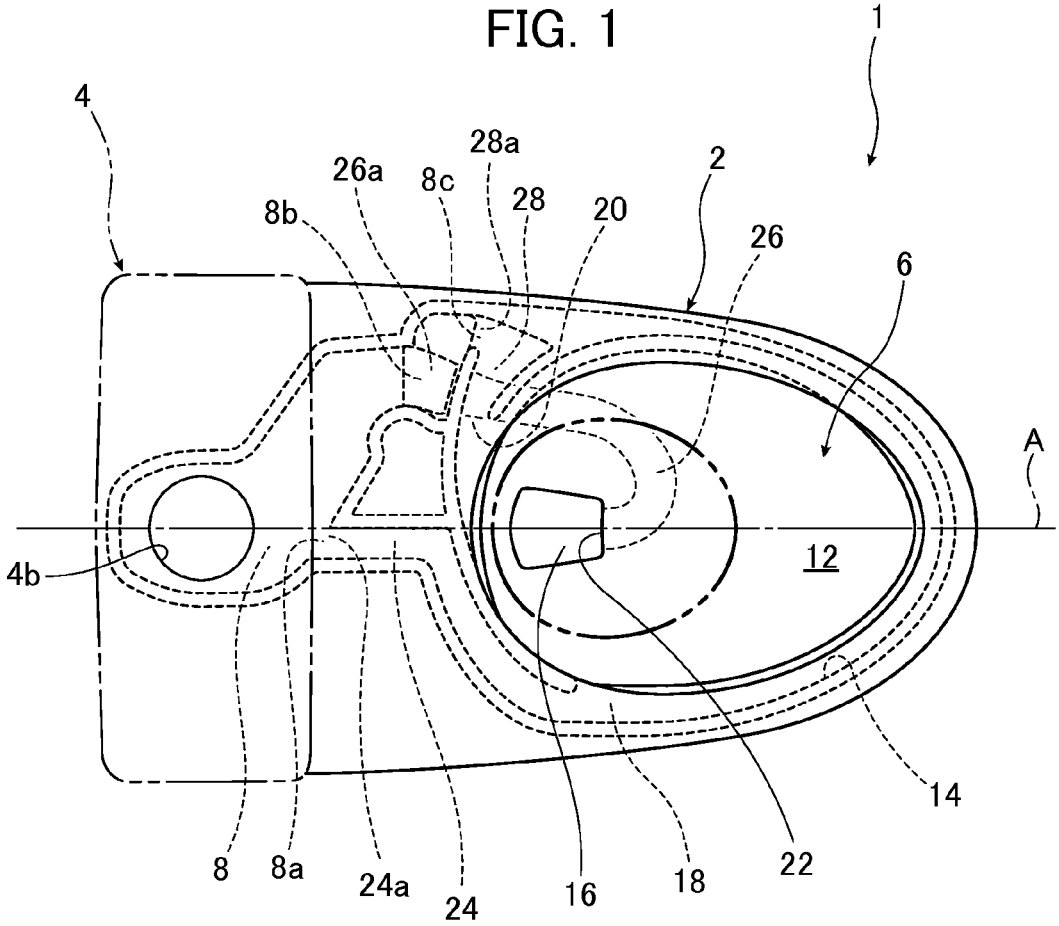
FIG. 1 is a top plan view of a flush toilet according to one embodiment of the present invention.
Figure 2:
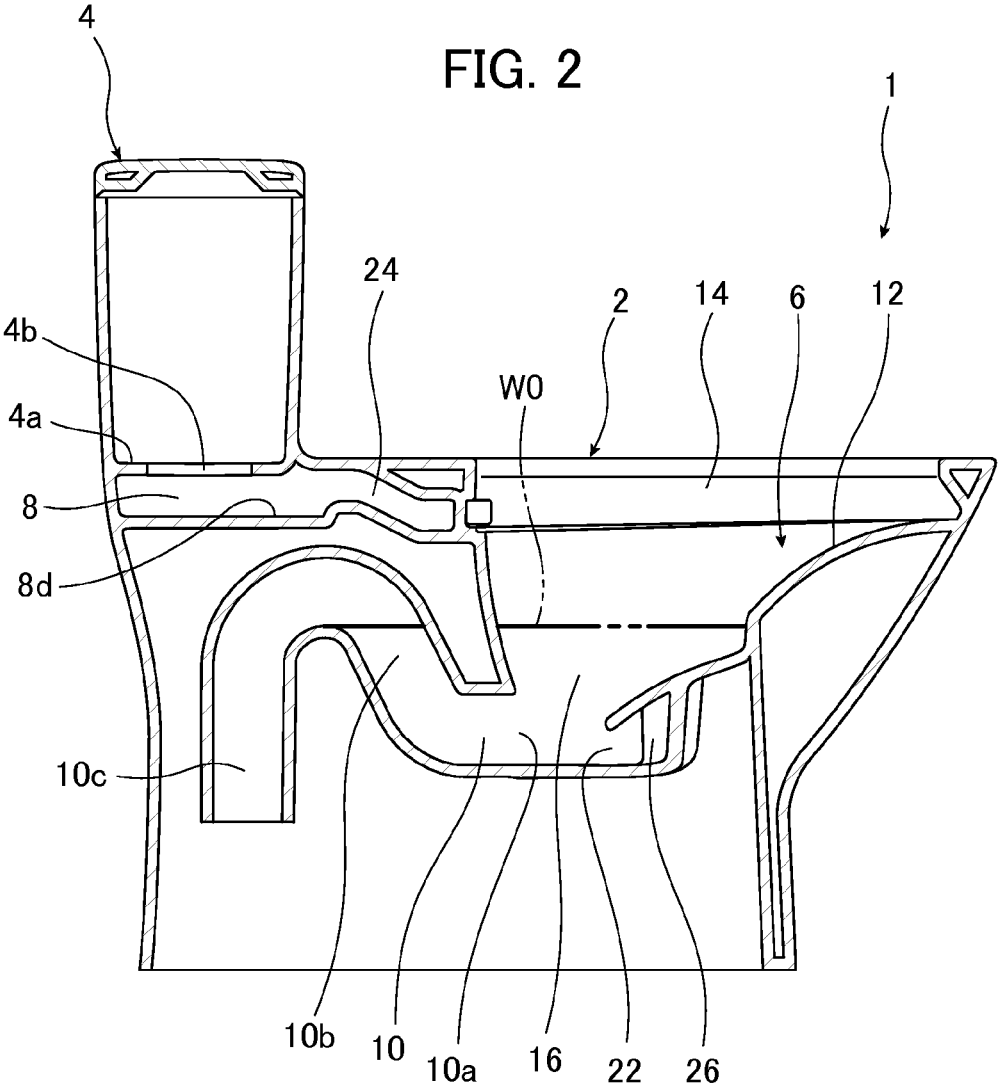
FIG. 2 is a vertical sectional view of the flush toilet illustrated in FIG. 1.
Figure 3:
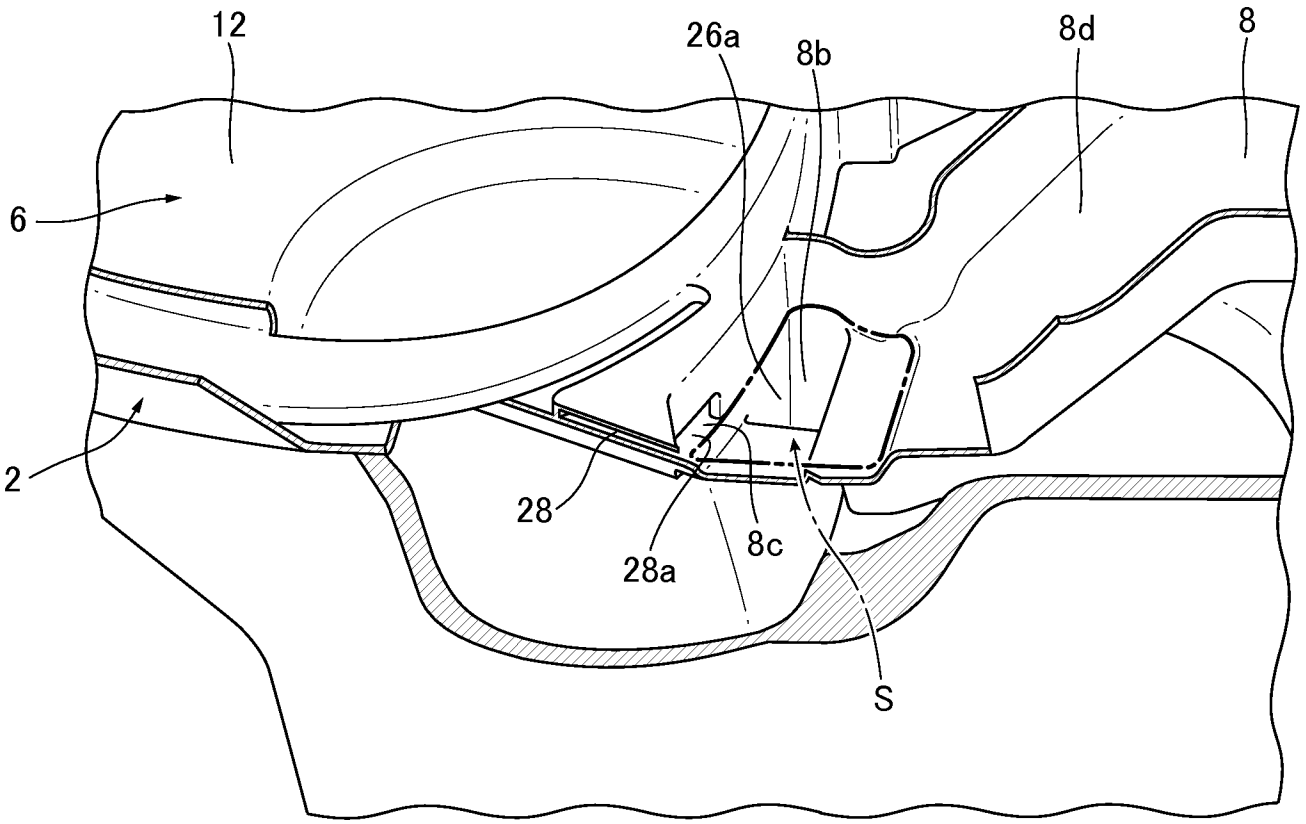
FIG. 3 is a schematic perspective view of a jet water guiding passage-feeding port and a second rim water guiding passage-feeding port of a flow dividing chamber in the flush toilet according to the embodiment of the present invention, when viewed downwardly from an upward and obliquely rearward side thereof.

With reference to FIGS. 1 to 3, a flush toilet according to one embodiment of the present invention will now be described. FIG. 1 is a top plan view of the flush toilet according to this embodiment, and FIG. 2 is a vertical sectional view of the flush toilet illustrated in FIG. 1.

Referring to FIGS. 1 and 2, the flush toilet according to this embodiment is designated generally by the reference code 1. The flush toilet 1 comprises a toilet main unit 2, and a reservoir tank unit 4 attached onto a top of a rear end of the toilet main unit 2. The reservoir tank unit 4 is configured to be placed, before initiation of flushing, in a state in which flush water supplied from an external water supply pipe (not illustrated) is store therein. The reservoir tank unit 4 is provided with a discharge valve (not illustrated) which is configured to be opened by manipulation of a manipulation device such as a manipulation lever (not illustrated) or a manipulation switch (not illustrated), to supply flush water to the toilet main unit 2 therethrough.

The toilet main unit 2 comprises: a bowl portion 6 formed in a front half of an upper section thereof; a flow dividing chamber 8 formed in an upper area of a rear half of the upper section; and a drainage trap conduit 10 formed just below the flow dividing chamber 8 to communicate with the bowl portion 6.

The bowl portion 6 has a bowl-shaped waste-receiving surface 12, and a rim 14 defining an inner peripheral surface constituting an upper edge thereof and facing inwardly. The waste-receiving surface 12 continuously connects with the inner peripheral surface defined by the rim 14 (inner peripheral surface of the rim 14) through a smooth curved surface. The inner peripheral surface of the rim 14 is formed in a shape having a certain amount of inward overhang. In top plan view, the bowl portion 6 is formed in an elliptical shape, wherein each of a front end region and a rear end region thereof has a relatively small curvature radius, and each of a right region and a left region thereof has a relatively large curvature radius. The bowl portion 6 has a lower region formed as a water pooling region 16 for storing therein water as pooled water. In FIG. 2, a pooled water level W0 of pooled water in the water pooling region 16 is indicated by the dashed line.

The drainage trap conduit 10 has a drainage-trap-conduit inlet port 10*a* opened at a position around a center of the waste-receiving surface 12 and below the pooled water level W0. The drainage trap conduit 10 is configured to form a rising passage 10*b* extending rearwardly from the drainage-trap-conduit inlet port 10*a*, and a lowering passage 10*c* (vertical passage) continuously connecting with the rising passage 10*b*. The lowering passage 10*c* has a lower end connected to a drain pipe (not illustrated) through a joint (not illustrated).

The reservoir tank unit 4 storing therein flush water is provided just above a rear region of the flow dividing chamber 8. The reservoir tank unit 4 has a bottom wall 4*a* formed with a discharge port 4*b* for allowing flush water therein to be discharged into the flow dividing chamber 8 therethrough when the discharge valve associated with the discharge port 4*b* is opened.

The reservoir tank unit 4 is a water-saving type reservoir tank unit. In this embodiment, a storable amount of flush water is 3.8 L. The storable amount of flush water for the reservoir tank unit 4 may be determined within a preferable range of 3.6 L to 4.2 L.

The toilet main unit 2 is also formed with a first rim water spouting portion 18, a second rim water spouting portion 20, and a jet water spouting portion (jet spout port) 22.

The first rim water spouting portion 18 is provided at a position lying in the rim 14 and corresponding to a lateral region of the bowl portion 6 (a position of the bowl portion 6 around a transition point from the relatively small curvature radius region to the relatively large curvature radius region, on one of laterally opposite sides with respect to a central axis A extending in a forward-rearward (longitudinal) direction), to spout flush water therefrom toward a forward side of the toilet main unit 2 in such a manner as to allow flush water to flush the bowl portion 6 while swirlingly flowing along the inner peripheral surface of the rim 14.

The second rim water spouting portion 20 is provided at a position lying in the rim 14 and corresponding to a rear region of the bowl portion 6 (a position of the bowl portion 6 around a transition point from the relatively large curvature radius region to the relatively small curvature radius region, on the other side, i.e., on a side opposite to the first rim water spouting portion 18), to spout flush water therefrom in such a manner as to allow flush water to flush the bowl portion 6 while swirlingly flowing along the inner peripheral surface of the rim 14 in the same swirling direction as that of flush water spouted from the first rim water spouting portion 18. These flush water streams fall in a swirling manner to allow waste on the surface of the bowl portion 6 to be flushed out.

The jet water spouting portion 22 is formed in a central region of a bottom of the bowl portion 6, and configured to be supplied with flush water from the flow dividing chamber 8. The jet water spouting portion 22 is configured to spout flush water therefrom toward the drainage-trap-conduit inlet port 10*a* of the drainage trap conduit 10 to thereby generate a siphon within a short period of time.

Further, the toilet main unit 2 is internally formed with: a first rim water guiding passage 24 for guiding flush water from the flow dividing chamber 8 to the first rim water spouting portion 18; a jet water guiding passage 26 for guiding flush water from the flow dividing chamber 8 to the jet water spouting portion 22; and a second rim water guiding passage 28 for guiding flush water from the flow dividing chamber 8 to the second rim water spouting portion 20.

With reference to FIGS. 1 to 4, the flow dividing chamber 8 will be described below in more detail.

Figure 4:
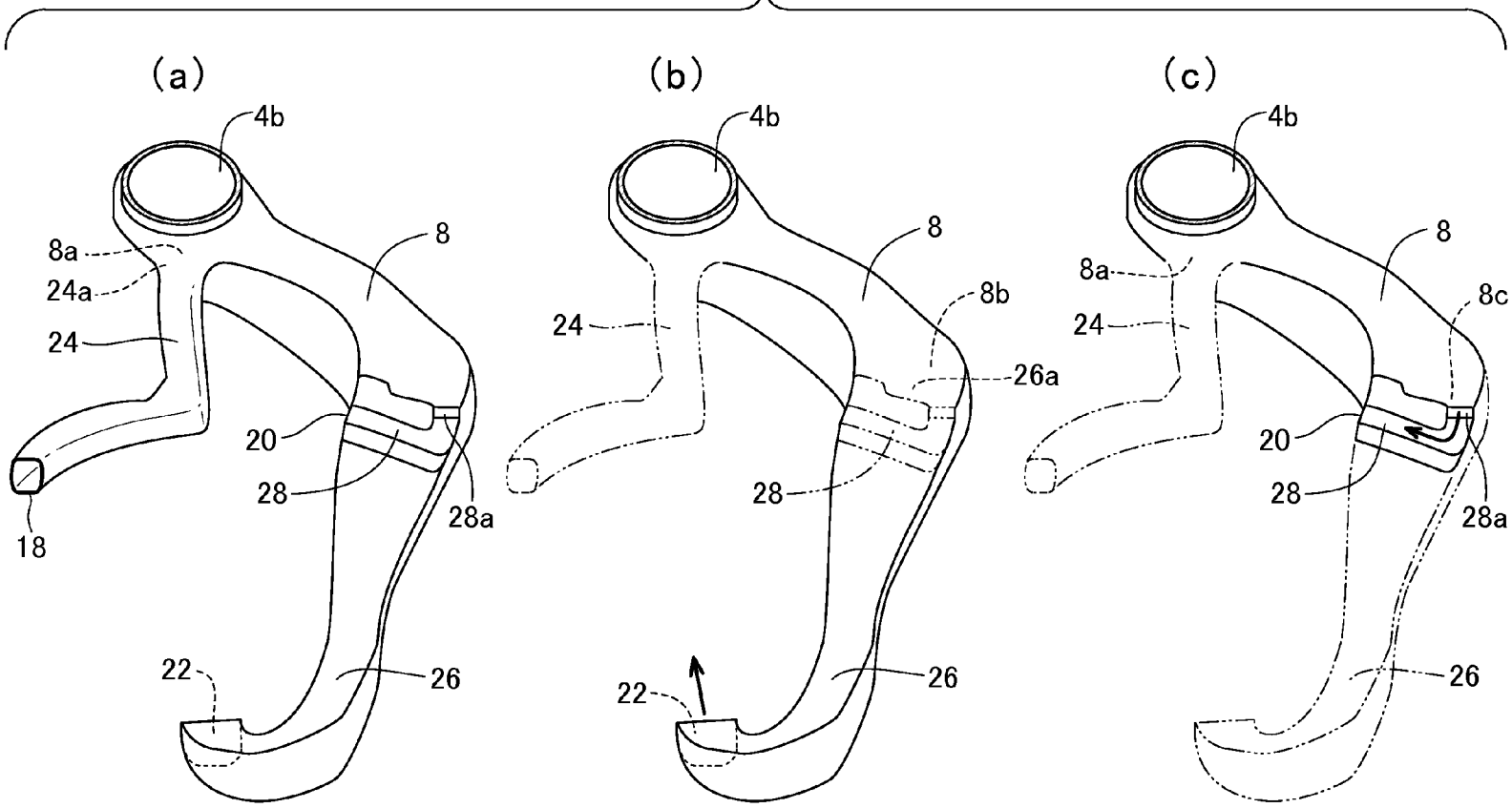
FIG. 4(*a*) is a diagram conceptually illustrating the flow dividing chamber, and a first rim water guiding passage, a jet water guiding passage and a second rim water guiding passage each connected to the flow dividing chamber, in the flush toilet according to the embodiment of the present invention, and FIG. 4(*b*) and FIG. 4(*c*) are, respectively: a diagram illustrating the jet water guiding passage in FIG. 4(*a*) in an easily understood manner, wherein each of the flow dividing chamber and the jet water guiding passage connected to the flow dividing chamber is indicated by the solid line, and each of the first rim water guiding passage and the second rim water guiding passage is indicated by the two-dot chain line; and a diagram illustrating the second rim water guiding passage in FIG. 4(*a*) in an easily understood manner, wherein each of the flow dividing chamber and the second rim water guiding passage connected to the flow dividing chamber is indicated by the solid line, and each of the first rim water guiding passage and the jet water guiding passage is indicated by the two-dot chain line.

FIG. 3 is a schematic perspective view of a jet water guiding passage-feeding port and a second rim water guiding passage-feeding port of the flow dividing chamber in the flush toilet according to this embodiment, when viewed downwardly from an upward and obliquely rearward side thereof. FIG. 4(*a*) is a diagram conceptually illustrating the flow dividing chamber, and the first rim water guiding passage, the jet water guiding passage and the second rim water guiding passage each connected to the flow dividing chamber, in the flush toilet according to this embodiment, and FIG. 4(*b*) and FIG. 4(*c*) are, respectively: a diagram illustrating the jet water guiding passage in FIG. 4(*a*) in an easily understood manner, wherein each of the flow dividing chamber and the jet water guiding passage connected to the flow dividing chamber is indicated by the solid line, and each of the first rim water guiding passage and the second rim water guiding passage is indicated by the two-dot chain line; and a diagram illustrating the second rim water guiding passage in FIG. 4(*a*) in an easily understood manner, wherein each of the flow dividing chamber and the second rim water guiding passage connected to the flow dividing chamber is indicated by the solid line, and each of the first rim water guiding passage and the jet water guiding passage is indicated by the two-dot chain line.

The flow dividing chamber 8 in the toilet main unit 2 is configured to form a water guiding passage extending rightwardly from a laterally central region of the rear end thereof toward a front end thereof, and divide flush water flowing from the discharge port 4*b* of the reservoir tank unit 4 into three streams. The flow dividing chamber 8 is formed with a first rim water guiding passage-feeding port 8*a* for allowing flush water to flow into the first rim water guiding passage 24 therethrough. The flow dividing chamber 8 is also formed with a jet water guiding passage-feeding port 8*b* for allowing flush water to flow into the jet water guiding passage 26 therethrough. The flow dividing chamber 8 is further formed with a second rim water guiding passage-feeding port 8*c* for allowing flush water to flow into the second rim water guiding passage 28 therethrough. The first rim water guiding passage-feeding port 8*a*, the jet water guiding passage-feeding port 8*b* and the second rim water guiding passage-feeding port 8*c* are arranged in this order from an upstream side of the flow dividing chamber 8.

The first rim water guiding passage-feeding port 8*a* of the flow dividing chamber 8 is connected to a first-rim-water-guiding-passage inlet portion 24*a* of the first rim water guiding passage 24. The jet water guiding passage-feeding port 8*b* of the flow dividing chamber 8 is connected to a jet-water-guiding-passage inlet portion 26*a* of he jet water guiding passage 26. The second rim water guiding passage-feeding port 8*c* of the flow dividing chamber 8 is connected to a second-rim-water-guiding-passage inlet portion 28*a* of the second rim water guiding passage 28.

The first rim water guiding passage-feeding port 8*a* of the flow dividing chamber 8 is disposed in adjacent relation to the discharge port 4*b* of the reservoir tank unit 4. More specifically, the first rim water guiding passage-feeding port 8*a* is disposed in front of and adjacent to the discharge port 4*b* and on a slightly left side with respect to the central axis A extending in the longitudinal direction of the toilet main unit 2, and formed as a through-hole opened in a sidewall of the flow dividing chamber 8 in a forward direction of the toilet main unit 2. As above, the first rim water guiding passage-feeding port 8*a* is disposed in adjacent relation to the discharge port 4*b*, so that it becomes possible to first perform spouting from the first rim water spouting portion 18, in as early timing as possible.

On the other hand, the jet water guiding passage-feeding port 8*b* of the flow dividing chamber 8 is disposed at a position away from the discharge port 4*b* of the reservoir tank unit 4, with respect to the first rim water guiding passage-feeding port 8*a*. More specifically, the jet water guiding passage-feeding port 8*b* is disposed to allow a distance from the discharge port 4*b* to the jet water guiding passage-feeding port 8*b* to become greater than a distance from the discharge port 4*b* to the first rim water guiding passage-feeding port 8*a*. Further, the jet water guiding passage-feeding port 8*b* is disposed at a position away from the central axis A extending in the longitudinal direction of the toilet main unit 2 by a given distance and adjacent to a lateral end of the toilet main unit 2. The jet water guiding passage-feeding port 8*b* is formed as a through-hole opened downwardly in a bottom wall 8*d* of the flow dividing chamber 8.

The second rim water guiding passage-feeding port 8*c* of the flow dividing chamber 8 is also disposed at a position away from the discharge port 4*b* of the reservoir tank unit 4, with respect to the first rim water guiding passage-feeding port 8*a*. More specifically, the second rim water guiding passage-feeding port 8*c* is disposed to allow a distance from the discharge port 4*b* to the second rim water guiding passage-feeding port 8*c* to become greater than the distance from the discharge port 4*b* to the first rim water guiding passage-feeding port 8*a*, and further to allow a distance from the discharge port 4*b* to the second rim water guiding passage-feeding port 8*c* to become greater than the distance from the discharge port 4*b* to the jet water guiding passage-feeding port 8*b*.

Further, the second rim water guiding passage-feeding port 8*c* is disposed at a position away from the central axis A extending in the longitudinal direction of the toilet main unit 2 by a given distance and adjacent to the lateral end of the toilet main unit 2, and formed as a through-hole opened in a part of a sidewall of the flow dividing chamber 8 in front of an upper space S of the jet water guiding passage-feeding port 8*b*.

With reference to FIGS. 3 and 4, the first rim water guiding passage 24, the jet water guiding passage 26 and the second rim water guiding passage 28 will be described below in more detail.

The first rim water guiding passage 24 is connected to the first rim water guiding passage-feeding port 8*a*. The first rim water guiding passage 24 is configured to form a water guiding passage which extends forwardly from the first-rim-water-guiding-passage inlet portion 24*a* along the central axis A, and, after extending while curving in an arc pattern, along a back surface of a sidewall defining the inner peripheral surface of the bowl portion 6, reaches the first rim water spouting portion 18.

The jet water guiding passage 26 is connected to the jet water guiding passage-feeding port 8*b*. The jet water guiding passage 26 is configured to form a water guiding passage which extends from the jet-water-guiding-passage inlet portion 26*a* downwardly and then forwardly, and, after being bent into a U shape at a position around a center of the bowl portion 6, reaches the jet water spouting portion 22 opened rearwardly.

The second rim water guiding passage 28 is connected to the second rim water guiding passage-feeding port 8*c*. The second rim water guiding passage 28 is configured to form a water guiding passage which extends from the second-rim-water-guiding-passage inlet portion 28*a* while being bent in a direction along the inner peripheral surface of the bowl portion 6, and reaches the second rim water spouting portion 20.

In the case where flush water first starts to flow into the first rim water guiding passage 24 from the first-rim-water-guiding-passage inlet portion 24*a*, a length of the first rim water guiding passage 24 is set to a value allowing the first rim water spouting portion 18 to first start to spout flush water.

In the case where flush water secondly starts to flow into the jet water guiding passage 26 from the jet-water-guiding-passage inlet portion 26*a*, a length of the jet water guiding passage 26 is set to a value allowing the jet water spouting portion 22 to secondly start to spout flush water, after start of the spouting of flush water from the first rim water spouting portion 18.

In the case where flush water lastly starts to flow into the second rim water guiding passage 28 from the second-rim-water-guiding-passage inlet portion 28*a*, a length of the second rim water guiding passage 28 is set to a value allowing the second rim water spouting portion 20 to lastly start to spout flush water, after start of the spouting of flush water from the jet water spouting portion 22.

In this embodiment, respective opening areas of the first rim water guiding passage-feeding port 8*a*, the jet water guiding passage-feeding port 8*b* and the second rim water guiding passage-feeding port 8*c* have the following relationship: the opening area of the jet water guiding passage-feeding port 8*b*>the opening area of the first rim water guiding passage-feeding port 8*a*>the opening area of the second rim water guiding passage-feeding port 8*c*.

Functions (operation) of the flush toilet according to the above embodiment will be described below.

First of all, when a user manipulates a manipulation device, such as a manipulation lever or a manipulation switch, of the reservoir tank unit 4, the discharge valve is opened, so that flush water is discharged from the reservoir tank unit 4, i.e., a supply of flush water to the toilet main unit 2 is initiated. Specifically, flush water falls from the discharge port 4*b* of the reservoir tank unit 4, and flows into the flow dividing chamber 8. Flush water flowing in the flow dividing chamber 8 is divided into a flush water stream flowing toward the first rim water guiding passage-feeding port 8*a*, and a flush water stream flowing toward the jet water guiding passage-feeding port 8*b* and the second rim water guiding passage-feeding port 8*c*.

The first rim water guiding passage-feeding port 8*a* is disposed in adjacent relation to the discharge port 4*b* of the reservoir tank unit 4, so that flush water inflowing from the discharge port 4*b* immediately reaches the first rim water guiding passage-feeding port 8*a*, and starts to flow into the first-rim-water-guiding-passage inlet portion 24*a*.

Then, a part of flush water divided so as to be supplied to the jet water guiding passage-feeding port 8*b* and the second rim water guiding passage-feeding port 8*c* reaches the jet water guiding passage-feeding port 8*b* the bottom wall 8*d* opened in the bottom wall 8*d* of the flow dividing chamber 8, and starts to flow into the jet-water-guiding-passage inlet portion 26*a*. As flush water flows from the jet water guiding passage-feeding port 8*b* into the jet-water-guiding-passage inlet portion 26*a*, the upper space S just above the jet water guiding passage-feeding port 8*b* will be gradually filled with flush water. When the upper space S is filled up with flush water, the flush water reaches the second rim water guiding passage-feeding port 8*c* opened in front of the upper space S, and starts to flow into the second-rim-water-guiding-passage inlet portion 28*a*. In this manner, flush water is distributed to the jet water guiding passage-feeding port 8*b* and the second rim water guiding passage-feeding port 8*c*.

Flush water first starting to flow from the first-rim-water-guiding-passage inlet portion 24*a* into the first rim water guiding passage 24 flows through the first rim water guiding passage 24. Thus, the first rim water spouting portion 18 first starts to spout flush water therefrom.

Flush water secondly first starting to flow from the jet-water-guiding-passage inlet portion 26*a* into the jet water guiding passage 26 flows through the jet water guiding passage 26, and the jet water spouting portion 22 secondly starts to spout flush water therefrom, after start of the spouting of flush water from the first rim water spouting portion 18.

Flush water lastly starting to flow from the second-rim-water-guiding-passage inlet portion 28*a* into the second rim water guiding passage 28 flows through the second rim water guiding passage 28, and the second rim water spouting portion 20 lastly starts to spout flush water therefrom, after start of the spouting of flush water from the jet water spouting portion 22.

In this regard, a relationship between the above order of start of spouting of flush water from the first rim water spouting portion 18, the jet water spouting portion 22 and the second rim water spouting portion 20, and flushing of the bowl portion 6 of the toilet main unit 2, will be described below.

Upon initiation of the supply of flush water from the reservoir tank unit 4 to the toilet main unit 2, the first rim water spouting portion 18 first starts to spout flush water therefrom. This makes it possible to initiate swirl flow-based flushing of the bowl portion 6 at earlier timing as compared to the conventional flush toilet in which flush water is first spouted from the jet water spouting portion 22. Flush water spouted from the first rim water spouting portion 18 falls down toward a center of the water pooling region 16, while swirlingly flowing primarily through the relatively large curvature radius region on one (e.g., left side, in front view) of laterally opposite sides of the bowl portion 6, the front, relatively small curvature radius region of the bowl portion 6, and the relatively large curvature radius region on the other side (e.g., right side, in front view). Such a swirlingly falling flow allows waste to gather in a center of pooled water in the bowl portion 6.

After start of the spouting of flush water from the first rim water spouting portion 18, the jet water spouting portion 22 starts to spout flush water therefrom toward the drainage-trap-conduit inlet port 10*a*. Thus, based on a synergetic effect of flush water spouted from the jet water spouting portion 22 and flush water spouted from the first rim water spouting portion 18 to the bowl portion 6 and falling in the water pooling region 16, it becomes possible to generate a siphon action at a later timing than the conventional flush toilet and more strongly than the conventional flush toilet. In addition, flush water spouted from the first rim water spouting portion 18 falls down while forming a swirl flow, and pushes waste and others into pooled water, so that it becomes possible to more effectively expel waste by the siphon action.

Lastly, the second rim water spouting portion 20 starts to spout flush water therefrom. This makes it possible to relatively quickly and adequately flush the rear, relatively small curvature radius region of the bowl portion 6 which has difficulty in undergoing flushing with flush water spouted from the first rim water spouting portion 18. Flush water spouted from the second rim water spouting portion 20 falls down while swirlingly flowing, primarily from the rear region toward the center of the water pooling region 16. Thus, even in a last phase of the flushing operation for the toilet main unit 2, it becomes possible to allow waste to more reliably gather in the center of the pooled water in the bowl portion 6.

That is, the flush toilet according to the above embodiment is configured such that, at or before termination of a siphon action generated by flush water spouted from the jet water spouting portion 22, flush water spouted from the first rim water spouting portion 18 completes flushing of the bowl portion 6, and flush water spouted from the second rim water spouting portion 20 completes flushing of the bowl portion 6. As above, the flush toilet according to the above embodiment is capable of, even in a situation where flushing is performed using a reduced amount of flush water, effectively flushing the entire region of the bowl portion 6, and allowing waste to gather in the center of the pooled water in the bowl portion 6 so as to expel the waste by a siphon action. Therefore, it becomes possible to effectively expel waste before termination of the siphon action.

In the above embodiment, at or before termination of a siphon action generated by flush water spouted from the jet water spouting portion 22, flushing of the bowl portion 6 by flush water spouted from the first rim water spouting portion 18, and flushing of the bowl portion 6 by flush water spouted from the second rim water spouting portion 20 are completed. Thus, the flush toilet 1 according to the above embodiment can improve toilet flushing performance in a situation where flushing is performed using a reduced amount of flush water in order to achieve a water-saving purpose.

After termination of the siphon action due to reduction in amount of flush water spouted from the jet water spouting portion 22, refill water is supplied until pooled water in the water pooling region 16 is increased up to the maximum water level WO, and the flushing operation for the toilet main unit 2 is terminated.

Figure 5:
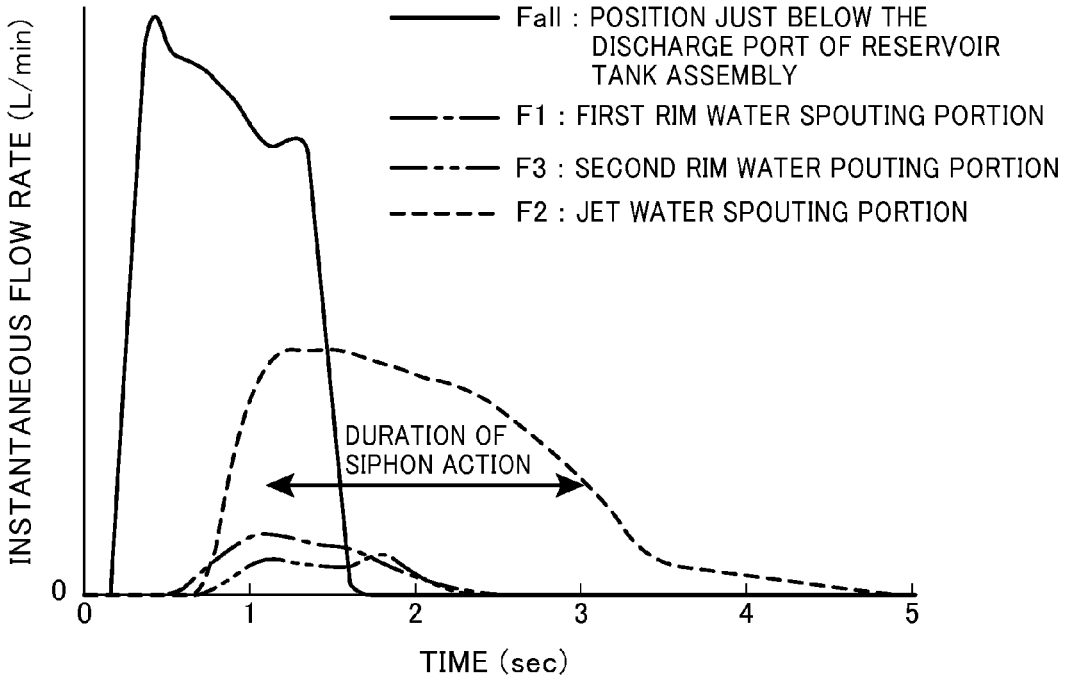
FIG. 5 is a diagram representing a relationship between an instantaneous flow rate (L/min) of flush water and a time (sec), in the flush toilet according to the embodiment of the present invention.

With reference to FIG. 5, a relationship between a flow rate of flush water, and a time, in the flush toilet according to the above embodiment will be described below.

FIG. 5 is a diagram representing a relationship between an instantaneous flow rate (L/min) of flush water and a time (sec), in the flush toilet according to the above embodiment.

In FIG. 5, an instantaneous flow rate of flush water as measured in the flow dividing chamber 8 at a position just below of the discharge port 4*b* of the reservoir tank unit 4 in the flush toilet according to the above embodiment is denoted by Fall. Further, an instantaneous flow rate of flush water as measured in the first rim water spouting portion 18 in the flush toilet 1 according to the above embodiment is denoted by F1. An instantaneous flow rate of flush water as measured in the jet water spouting portion 22 in the flush toilet 1 according to the above embodiment is denoted by F2. An instantaneous flow rate of flush water as measured in the second rim water spouting portion 20 in the flush toilet 1 according to the above embodiment is denoted by F3.

As illustrated in FIG. 5, upon initiation of the flushing operation, flush water is supplied from the discharge port 4*b* of the reservoir tank unit 4 to the flow dividing chamber 8, so that, after the instantaneous flow rate Fall rises, the first rim water spouting portion 18 first starts to spout flush water therefrom, and thus the instantaneous flow rate F1 rises. Then, after start of the spouting of flush water from the first rim water spouting portion 18, the jet water spouting portion 22 starts to spout flush water therefrom, and thus the instantaneous flow rate F2 rises. Lastly, the second rim water spouting portion 20 starts to spout flush water therefrom, and thus the instantaneous flow rate F3 rises.

In this process, when the jet water spouting portion 22 starts to spout flush water therefrom, a siphon action is generated. This siphon action is continuously generated for a time of about 1.2 to 3 seconds, which is shorter than the conventional flush toilet. Because an amount of flush water is reduced for water-saving, a time period in which the siphon action can be continued, i.e., a duration of the siphon action, is reduced to a short time of about 2 seconds. As illustrated in FIG. 5, within a period in which spouting of flush water from the jet water spouting portion 22 is continued to allow the siphon action to be maintained, the instantaneous flow rate F1 of flush water from the first rim water spouting portion 18 lowers, and thus flushing of the bowl portion 6 by flush water spouted from the first rim water spouting portion 18 is terminated. Further, the instantaneous flow rate F3 of flush water from the second rim water spouting portion 20 lowers, and thus flushing of the bowl portion 6 by flush water spouted from the second rim water spouting portion 20 is terminated.

Further, the instantaneous flow rate F3 of flush water lastly spouted from the second rim water spouting portion 20 increases at a relatively late timing. This allows flush water spouted from the second rim water spouting portion 20 to fall in the water pooling region 16, when the instantaneous flow rate F2 of flush water spouted from the jet water spouting portion 22 starts decreasing. Thus, it becomes possible to prevent premature termination of the siphon action, and further increase the duration of the siphon action.

As mentioned above, in the flush toilet 1 according to the above embodiment, the first rim water spouting portion 18 first starts to spout flush water therefrom, so that it becomes possible to initiate swirl flow-based flushing of the bowl portion 6 earlier than the conventional flush toilet. Thus, it becomes possible to allow waste to gather in a center of pooled water in the bowl portion 6 at an earlier timing than the conventional flush toilet. Then, after start of the spouting of flush water from the first rim water spouting portion 18, the jet water spouting portion 22 starts to spout flush water therefrom. Thus, based on a synergetic effect of flush water spouted from the jet water spouting portion 22 and flush water spouted from the first rim water spouting portion to the bowl portion 6, it becomes possible to expel waste by a siphon action, at a later timing than the conventional flush toilet. Lastly, the second rim water spouting portion 20 starts to spout flush water therefrom. This makes it possible to quickly flush the rear region of the bowl portion 6 which has difficulty in undergoing flushing with flush water spouted from the first rim water spouting portion 18, and allow waste to gather in the center of the pooled water in the bowl portion 6 while the siphon action continues. As a result, the flush toilet according to the above embodiment can complete flushing of the bowl portion 6 at or before termination of the siphon action, thereby improving toilet flushing performance in a situation where flushing is performed while generating a siphon action by using a reduced amount of flush water.

In the flush toilet 1 according to the above embodiment, first, flush water flows into the first rim water guiding passage 24 through the first rim water guiding passage-feeding port 8*a* from an upstream side of the flow dividing chamber 8, to allow the first rim water spouting portion 18 to start to spout flush water therefrom. Then, flush water flows into the jet water guiding passage 26 through the jet water guiding passage-feeding port 8*b* arranged on a second upstreammost side of the flow dividing chamber 8, to allow the jet water spouting portion 22 to start to spout flush water therefrom. Lastly, flush water flows into the second rim water guiding passage 28 through the second rim water guiding passage-feeding port 8*c* arranged on a downstreammost side of the flow dividing chamber 8, to allow the second rim water spouting portion 20 to start to spout flush water therefrom. Thus, the first rim water spouting portion 18 first starts to spout flush water therefrom. Therefore, it becomes possible to initiate swirl flow-based flushing of the bowl portion 6 earlier than the conventional flush toilet, and allow waste to gather in the center of the pooled water in the bowl portion 6 at an earlier timing than the conventional flush toilet. Then, after start of the spouting of flush water from the first rim water spouting portion 18, the jet water spouting portion 22 starts to spout flush water therefrom. Thus, based on a synergetic effect of flush water spouted from the jet water spouting portion 22 and flush water spouted from the first rim water spouting portion 18 to the bowl portion 6, it becomes possible to expel waste by a siphon action, at a later timing than the conventional flush toilet. Lastly, the second rim water spouting portion 20 starts to spout flush water therefrom. Thus, it becomes possible to quickly flush the rear region of the bowl portion 6 which has difficulty in undergoing flushing with flush water spouted from the first rim water spouting portion 18, and allow waste to gather in the center of the pooled water in the bowl portion 6 within the duration of the siphon action. As a result, the flush toilet 1 according to the above embodiment can complete flushing of the bowl portion 6 at or before termination of the siphon action, thereby improving toilet flushing performance in the situation where flushing is performed while generating a siphon action by using a reduced amount of flush water.

In the flush toilet 1 according to the above embodiment, flush water discharged from the reservoir tank unit 4 is guided from the first rim water guiding passage-feeding port 8*a* to the first rim water spouting portion 18, reliably at an earliest timing, so that it becomes possible to allow the first rim water spouting portion 18 to start to spout flush water therefrom at the earliest timing.

In the flush toilet 1 according to the above embodiment, it becomes possible to allow the first rim water spouting portion 18 to start to spout flush water therefrom at the earliest timing in a reliable manner. Then, after start of the spouting of flush water from the first rim water spouting portion 18, the jet water spouting portion 22 secondly starts to spout flush water therefrom. Thus, based on a synergetic effect of flush water spouted from the jet water spouting portion 22 and flush water spouted from the first rim water spouting portion 18 to the bowl portion 6, it becomes possible to expel waste by a siphon action, at a later timing than the conventional flush toilet, in a more reliable manner. The second rim water guiding passage-feeding port 8*c* is disposed in adjacent relation to the jet water guiding passage-feeding port 8*b*, so that it becomes possible to allow the second rim water spouting portion 20 to start to spout flush water therefrom at a timing relatively shortly after start of the spouting of flush water from the jet water spouting portion 22. As a result, the flush toilet 1 according to the above embodiment can complete flushing of the bowl portion 6 at or before termination of the siphon action, thereby improving toilet flushing performance in the situation where flushing is performed while generating a siphon action by using a reduced amount of flush water.

What is claimed is:

1. A flush toilet using flush water to flush a toilet main unit, comprising:

a reservoir tank storing therein flush water to be supplied to the toilet main unit, the reservoir tank being formed with a discharge port for discharging flush water therethrough;

a bowl portion having a bowl-shaped waste-receiving surface, and a rim defining an inner peripheral surface of the bowl portion located along an upper edge of the bowl portion;

a drainage passage having an inlet connected to a lower region of the bowl portion to expel waste therethrough by a siphon action;

a first rim water spouting portion provided at a position lying in the rim and corresponding to a lateral region of the bowl portion, to spout flush water therefrom toward a forward side of the toilet main unit in such a manner as to allow the flush water to flush the bowl portion while swirlingly flowing along the inner peripheral surface of the rim;

a second rim water spouting portion provided at a position lying in the rim and corresponding to a rear region of the bowl portion, to spout flush water therefrom in such a manner as to allow the flush water to flush the bowl portion while swirlingly flowing along the inner peripheral surface of the rim in a same swirling direction as that of flush water spouted from the first rim water spouting portion;

a jet water spouting portion for spouting flush water therefrom toward an inlet of the drainage passage;

a flow dividing chamber for dividing flush water flowing therein from the discharge port of the reservoir tank;

a first rim water guiding passage for guiding flush water from the flow dividing chamber to the first rim water spouting portion;

a jet water guiding passage for guiding flush water from the flow dividing chamber to the jet water spouting portion; and a second rim water guiding passage for guiding flush water from the flow dividing chamber to the second rim water spouting portion, wherein the flush toilet is configured such that, after the first rim water spouting portion starts to spout flush water therefrom, the jet water spouting portion and the second rim water spouting portion start to spout flush water therefrom, in this order.

2. The flush toilet according to claim 1, wherein the flow dividing chamber is formed with: a first rim water guiding passage-feeding port for allowing flush water to flow into the first rim water guiding passage therethrough; a jet water guiding passage-feeding port for allowing flush water to flow into the jet water guiding passage therethrough; and a second rim water guiding passage-feeding port for allowing flush water to flow into the second rim water guiding passage therethrough, and wherein the first rim water guiding passage-feeding port, the jet water guiding passage-feeding port and the second rim water guiding passage-feeding port are arranged in this order from an upstream side of the flow dividing chamber.

3. The flush toilet according to claim 2, wherein the first rim water guiding passage-feeding port of the flow dividing chamber is disposed in adjacent relation to the discharge port of the reservoir tank.

4. The flush toilet according to claim 3, wherein each of the jet water guiding passage-feeding port and the second rim water guiding passage-feeding port is disposed at a position away from the discharge port by a distance greater than a distance from the discharge port to the first rim water guiding passage-feeding port, and wherein the second rim water guiding passage-feeding port is disposed in adjacent relation to the jet water guiding passage-feeding port.

* * * * *